US006508662B1

(12) United States Patent
Yu

(10) Patent No.: US 6,508,662 B1
(45) Date of Patent: Jan. 21, 2003

(54) ELECTRICAL CONNECTOR FOR TWO FLEXIBLE PRINTED CIRCUITS

(75) Inventor: Hung-Chi Yu, Hsi-Chih (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/039,433

(22) Filed: Jan. 3, 2002

(30) Foreign Application Priority Data

Nov. 30, 2001 (TW) ..... 090220804

(51) Int. Cl.[7] ..... H01R 12/24
(52) U.S. Cl. ..... 439/498; 439/495
(58) Field of Search ..... 439/495, 498, 439/260

(56) References Cited

U.S. PATENT DOCUMENTS 4,959,030 A * 9/1990 Tatebe et al. ..... 439/498
5,501,610 A * 3/1996 Ikemoto ..... 439/498
5,803,752 A * 9/1998 McHugh ..... 439/495
6,146,172 A * 11/2000 Wu et al. ..... 439/498

* cited by examiner

*Primary Examiner*—Gary Paumen
(74) *Attorney, Agent, or Firm*—Wei Te Chung

(57) ABSTRACT

An electrical connector (1) includes an insulating housing (10) having a mating face (101) and a mounting face (102), a plurality of fist and second conductive contacts (21, 22) and a stuffer (30). An interior chamber (11) is defined in the housing and through the mating face. The interior chamber has opposite first and second sidewalls (111, 112). Each sidewall defines a plurality of receiving passageways (12, 13). The first contacts are received in the passageways defined in the first sidewall and are provided to electrically mate with a first flexible printed circuit (FPC). The second contacts are received in the passageways defined in the second sidewall and are provided to electrically mate with a second FPC. The stuffer has a stuffer portion (32). The stuffer portion is pressed into the interior chamber to cause the FPCs to securely and electrically mate with the contacts.

1 Claim, 3 Drawing Sheets

ELECTRICAL CONNECTOR FOR TWO FLEXIBLE PRINTED CIRCUITS

FIELD OF THE INVENTION

The present invention relates to an electrical connector, and more particularly, to an electrical connector which is capable of electrically mating with two flexible printed circuits (FPCs).

BACKGROUND OF THE INVENTION

As is well known, a flexible printed circuit (FPC) connector generally comprises an insulative housing defining an interior space, a plurality of conductive terminals and a stuffer. The housing defines a plurality of receiving slots communicating with the interior space for receiving the terminals. The terminals each have a resilient contacting arm for contacting and establishing electrical connection with a FPC. When the FPC is inserted into the interior space, the stuffer is provided to secure the FPC within the housing to electrically engage with the terminals. However, each conventional connector is capable of interconnecting only one FPC with an electrical device. If an electrical device needs to connect more FPCs, more such conventional connectors are needed, one for each FPC. These connectors must occupy extra printed board space of the electrical device and may result in complex arrangement in the electrical device. These connectors are also disadvantageous due to trend of decreasing the size of the electrical device.

The present invention is directed to an improved electrical connector having two kinds of terminals therein, which electrically connects with two FPCs so as to prevent occupation of extra space.

BRIEF SUMMARY OF THE INVENTION

A main object of the present invention is to provide an electrical connector which is capable of mating with two flexible printed circuits (FPCs).

An electrical connector in accordance with the present invention comprises an insulative housing, a plurality of first and second conductive contacts and a stuffer. The housing has a mating face and a mounting face. An interior chamber is defined in the housing and through the mating face. The housing defines a pair of insertion holes. The interior chamber has opposite first and second sidewalls. The first sidewall defines a plurality of first receiving passageways for receiving the first contacts. The second sidewall defines a plurality of second receiving passageways for receiving the second contacts. The first contacts are provided to electrically mate with a first flexible printed circuit (FPC). The second contacts are provided to electrically mate with a second FPC. Each contact includes a fixing portion, a contacting portion extending from the fixing portion and a soldering portion extending from the fixing portion. Each contacting portion includes a contacting projection projecting therefrom. The stuffer has a cover, a stuffer portion protruding from the cover and a pair of insertion arms. The stuffer portion is pressed into the interior chamber to cause the FPCs to securely and electrically mate with the contacts. The insertion arms engage with the insertion holes to secure the stuffer in the housing.

Other objects, advantages and novel features of the invention will become more apparent from the following detailed description when taken in conjunction with the accompanying drawings.

DETAILED DESCRIPTION OF THE INVENTION

Figure 1:
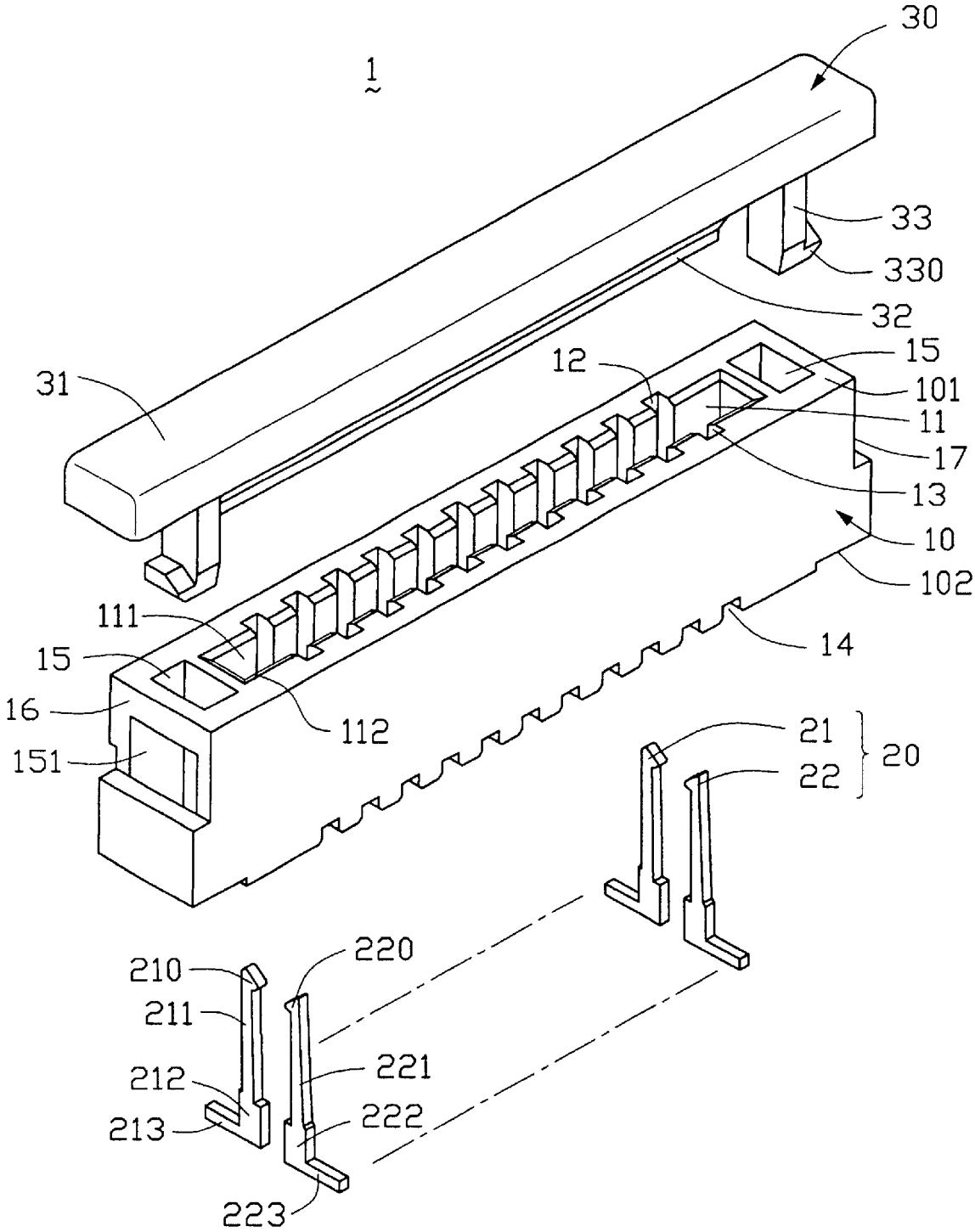
FIG. 1 is an exploded view of an electrical connector of the present invention.
Figure 2:
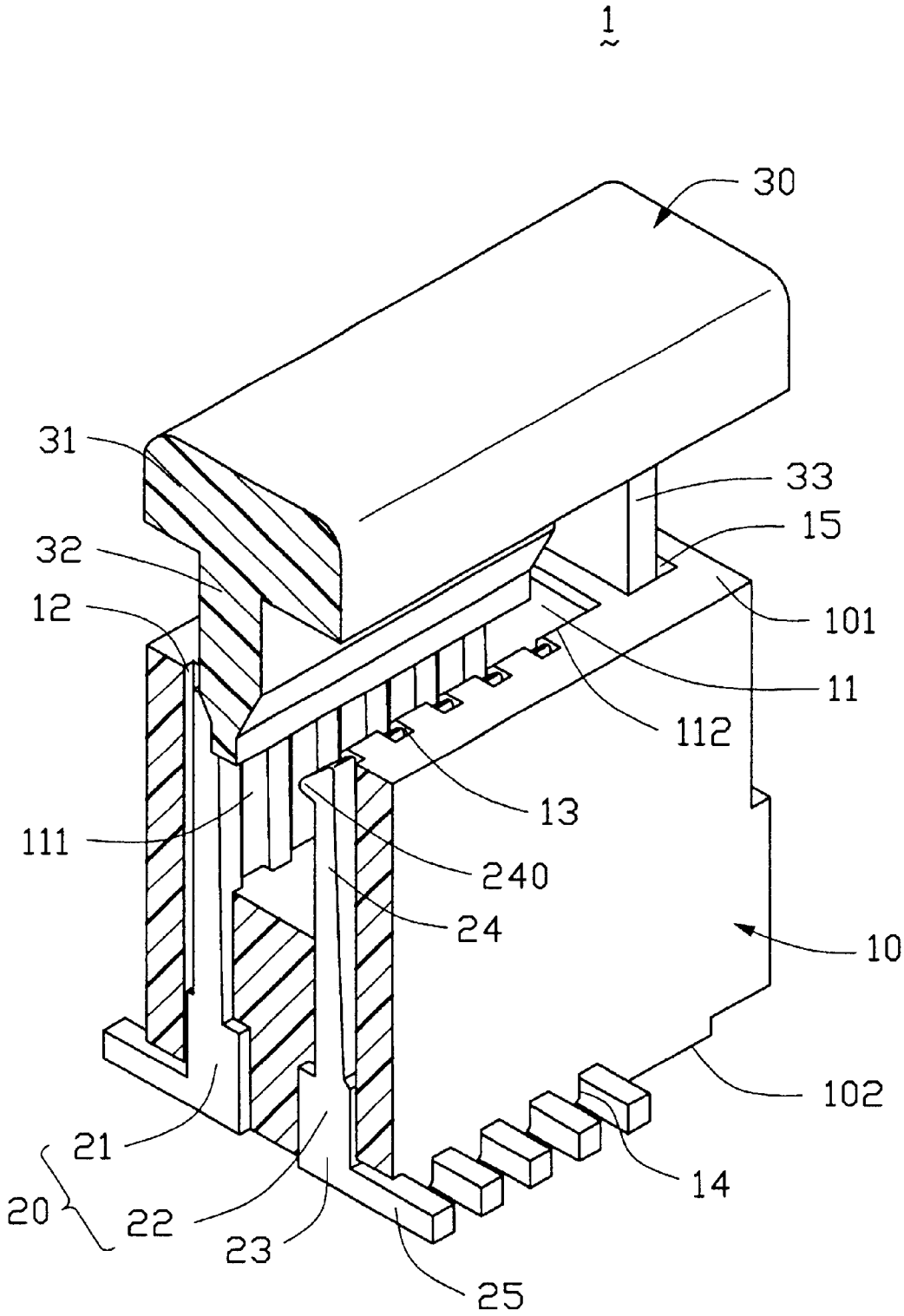
FIG. 2 is a cut-away view showing a part of the electrical connector of FIG. 1.

Referring to FIGS. 1 and 2, an electrical connector 1 according to the present invention for a first and a second flexible printed circuits (FPCs) (not shown) is a vertical insertion type connector, comprising an insulative housing 10, a plurality of first conductive contacts 21, a plurality of second conductive contacts 22 and a stuffer 30.

The housing 10 is substantially cubic and comprises a top mating face 101 and a bottom mounting face 102 opposite to the top mating face 101. An interior chamber 11 is defined longitudinally in the housing 10 and through the top mating face 101 of the housing 10 for receiving the two FPCs and the stuffer 30. The interior chamber 11 has opposite first and second inner sidewalls 111, 112. The first sidewall 11 defines a plurality of first receiving passageways 12 communicating with the interior chamber 11. The second sidewall 112 defines a plurality of second receiving passageways 13 communicating with the interior chamber 11. A plurality of channels 14 are defined in the bottom mounting face 102 of the housing 10 and communicate respectively with corresponding first and second receiving passageways 12, 13. A pair of insertion holes 15 are defined in the top mating face 101 of the housing 10 in a top-to-bottom direction and are disposed near opposite ends (not labeled) of the interior chamber 11. Each insertion hole 15 defines outwardly a lateral hole 151 communicating with outside through opposite sidewalls 16, 17 of the housing 10.

The first contacts 21 are provided to contact with the first FPC. Each first contact 21 includes a fixing portion 212, a resilient contact arm 211 extending upwardly and inwardly from the fixing portion 212 and a soldering portion 213 extending laterally from the fixing portion 212. The contact arm 211 forms a contact projection 210 on a free end thereof for electrically mating with the first FPC. The soldering portion 213 is provided to solder to a circuit board (no shown) of an electrical device (not shown). The second contacts 22 are provided to contact with the second FPC. The second contacts 22 each include a fixing portion 222, a contact arm 221 extending from the fixing portion 222 and a soldering portion 223 extending from the fixing portion 222. The contact arm 221 forms a contact projection 220 on a free end thereof for electrically mating with the second FPC. In this embodiment, the second contacts 22 are substantially same as the first contacts 21.

A cross-section (not labeled) of the stuffer 30 is T-shaped. The stuffer 30 includes an elongate cover 31, an elongate insertion portion 32 and a pair of spring latch arms 33. The insertion portion 32 protrudes downwardly from a central portion (not labeled) of the cover 31. The latch arms 33 downwardly protrude from the cover 31 and are disposed near opposite ends (not labeled) of the insertion portion 32. Each latch arm 33 has an armlock 330 formed on a free end (not labeled) thereof.

In assembly, from the bottom mounting face 102 of the housing 10, the first contacts 21 are inserted into corresponding first receiving passageways 12 with the contact arms 211 and the fixing portions 212 thereof respectively received in the corresponding first receiving passageway 12, and with the soldering portions 213 thereof respectively received in corresponding channels 14. Similarly, the second contacts 22 are respectively inserted into corresponding second receiving passageways 13 from the mounting face 102 of the housing 10 with the contact arms 221 and the fixing portions 22 thereof received respectively in corresponding second receiving passageways 13, and the soldering portion 223 thereof respectively received in corresponding channels 14. The contact projections 210, 220 of the first and the second contacts 11, 12 project into the interior chamber 11. The stuffer 30 is mounted onto the housing 10 with the spring latch arms 33 thereof received in corresponding insertion holes 15 of the housing 10, and with the stuffer portion 32 thereof inserted into an upper potion (not labeled) of the interior chamber 11, wherein there are gaps (not labeled) between the first sidewall 111 and the stuffer portion 32, and between the second sidewall 112 and the stuffer portion 32.

In use, the first and the second FPCs are inserted into the interior chamber from the gaps between the first and the second sidewalls 111, 112 of the interior chamber 11 and the stuffer portion 32. Subsequently, the stuffer 30 is pressed into a lower portion (not labeled) of the interior chamber 11 with the armlocks 330 thereof mating with corresponding lateral holes 151. The insertion portion 32 of the stuffer 30 presses against the first and the second FPCs and urges the FPCs to securely and electrically engage with the contact projections 210 and 220.

Figure 3:
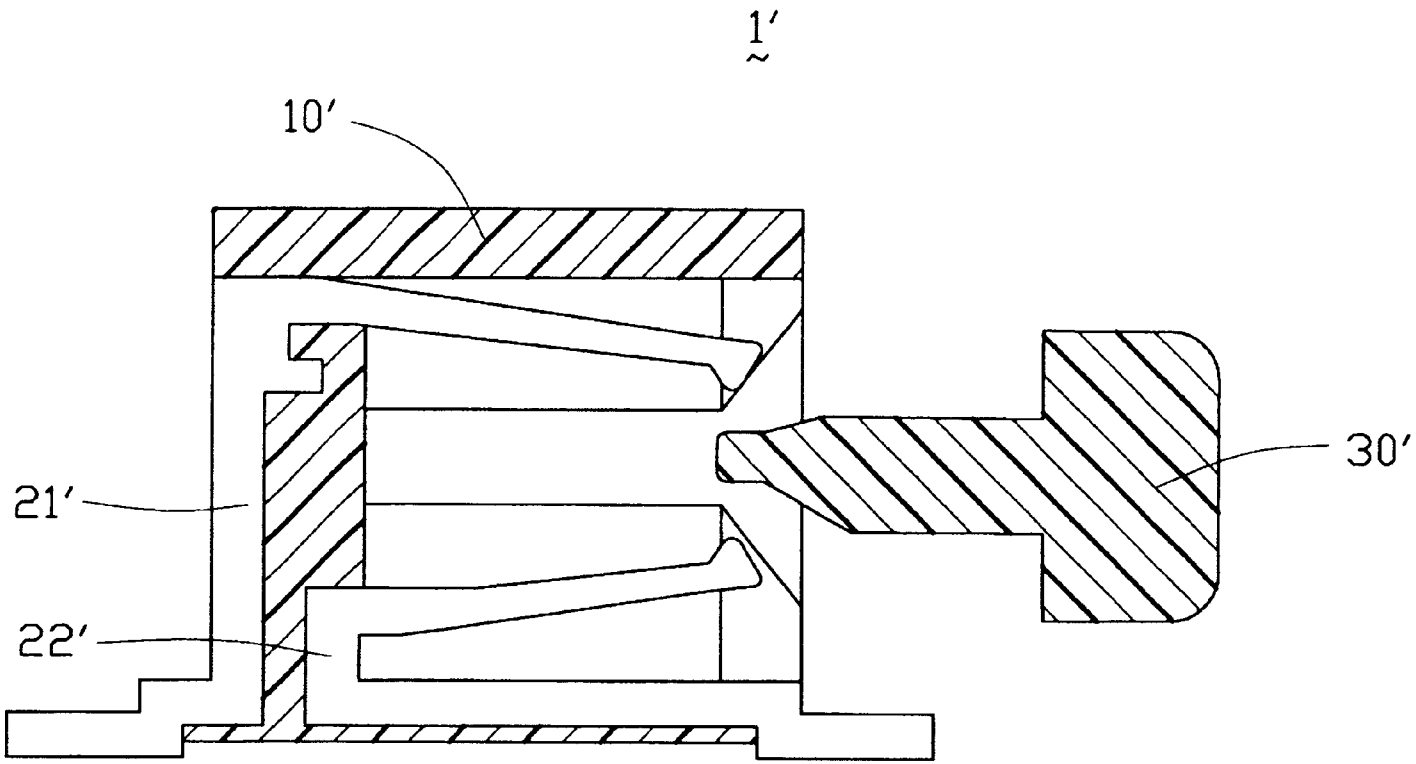
FIG. 3 is a cross-sectional view of a second embodiment of the present invention.

A second embodiment of the present invention is shown in FIG. 3. An electrical connector 1' is a horizontal insertion type connector, comprising an insulative housing 10', a plurality of first conductive contacts 21', a plurality of second conductive contacts 22' and a stuffer 30'. Each component 10', 21', 22', 30' of the electrical connector 1' is similar to the electrical connector's 1. The electrical connector 1' is same as the electrical connector 1 in assembly manner and in operation.

The present invention may define more than one interior chamber in the housing thereof. Each interior chamber is provided to receive two FPCs. The present invention, therefore, is capable of electrically mating with more than two FPCs.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted to be used with a first flexible printed circuit and a second flexible printed circuit, comprising:

an insulating housing having a mating face and a mounting face, an interior chamber being defined in the housing and through the mating face, the interior chamber having opposite first and second sidewalls;

a plurality of first conductive contacts being received in the first sidewall of the interior chamber and being provided to electrically mate with the first flexible printed circuit;

a plurality of second conductive contacts being received in the second sidewall of the interior chamber and being provided to electrically mate with the second flexible printed circuit; and a stuffer having a stuffer portion being pressed into the interior chamber of the housing to cause the first and second flexible printed circuits to securely;

wherein the first sidewall of the interior chamber defines a plurality of first receiving passageways communicating with the interior chamber for receiving the first contacts, and wherein the second sidewall of the interior chamber defines a plurality of second receiving passageways communicating with the interior chamber for receiving the second contacts;

wherein the first and the second contacts each comprise a fixing portion, a contacting arm extending from the fixing portion and a soldering portion extending from the fixing portion, the contacting arms being respectively received in corresponding receiving passageways, and wherein the housing defines a plurality of channels respectively communicating with corresponding receiving passageways in the mounting face thereof for receiving the soldering portions of the first and the second contacts;

wherein the contacting arms of the first and the second contacts comprise a contacting projection projecting therefrom and projecting into the interior chamber to electrically mate with the flexible printed circuits;

wherein the stuffer comprises a cover extending from the stuffer portion and at least one fixing arm extending from the cover, and wherein the housing. defines at least one insertion hole therein for receiving the at least one fixing arm;

wherein the at least one fixing arm of the stuffer forms an armlock, and wherein the at least one insertion hole of the housing defines a lateral hole for mating with the armlock;

wherein the housing defines a plurality of interior chambers therein for receiving a plurality of FPC's, each interior chamber receiving a plurality of first contacts and second contacts for electrically mating with two FPC's.

* * * * *